US009999892B2

(12) United States Patent
Smith et al.

(10) Patent No.: US 9,999,892 B2
(45) Date of Patent: Jun. 19, 2018

(54) METHOD AND APPARATUS OF PROCESSING WHOLE TOBACCO PLANTS

(71) Applicants: DRSW, LLC, Lexington, KY (US); Julie Ross, Versailles, KY (US)

(72) Inventors: Timothy D. Smith, Lexington, KY (US); George B. Day, V, Lexington, KY (US); Larry G. Wells, Lexington, KY (US); Ira J. Ross, Versailles, KY (US)

(73) Assignee: DRSW, LLC, Nicholasville, KY (US)

( * ) Notice: Subject to any disclaimer, the term of this patent is extended or adjusted under 35 U.S.C. 154(b) by 517 days.

(21) Appl. No.: 14/844,604

(22) Filed: Sep. 3, 2015

(65) Prior Publication Data

US 2017/0064992 A1 Mar. 9, 2017

(51) Int. Cl.

| | |
|---|---|
| ***B02C 23/00*** | (2006.01) |
| ***B02C 23/14*** | (2006.01) |
| ***A24B 3/16*** | (2006.01) |
| ***A24B 7/14*** | (2006.01) |
| ***B02C 21/00*** | (2006.01) |
| ***B02C 23/32*** | (2006.01) |

(52) U.S. Cl.

CPC ..... *B02C 23/14* (2013.01); *A24B 3/16* (2013.01); *A24B 7/14* (2013.01); *B02C 21/00* (2013.01); *B02C 23/32* (2013.01)

(58) Field of Classification Search

CPC ..... B02C 23/14; B02C 23/32; B02C 21/00; A24B 5/10; A24B 7/14; A24B 3/16

USPC ..... 131/311, 319, 322

See application file for complete search history.

(56) References Cited

U.S. PATENT DOCUMENTS

| | | | | |
|---|---|---|---|---|
| 3,794,049 A * | 2/1974 | Wochnowski | ..... | A24B 7/14 131/108 |
| 4,037,712 A * | 7/1977 | Wochnowski | ..... | A24B 7/14 131/303 |
| 4,149,547 A * | 4/1979 | Komossa | ..... | A24B 7/14 131/108 |

(Continued)

FOREIGN PATENT DOCUMENTS

| | | |
|---|---|---|
| CN | 102048237 A | 5/2011 |
| EP | 0135999 | 4/1985 |
| GB | 1186802 | 4/1970 |

OTHER PUBLICATIONS

U.S. Appl. No. 61/750,575; "Method and Apparatus of Processing Whole Tobacco Plants", filed Jan. 9, 2013.
English machine translation of CN102048237A.

*Primary Examiner* — Faye Francis
(74) *Attorney, Agent, or Firm* — King & Schickli, PLLC

(57) ABSTRACT

A method and apparatus are provided for processing whole tobacco plants. The method includes cutting the whole tobacco plants into segments in a segmenter assembly, classifying the segments by leaf characteristics, separating leaf material from a waste material stream of undesirable stalk and shatter material for each class of leaf characteristics and reclaiming portions of leaf material trapped in the waste material and recycling the reclaimed portions of leaf material to the segmenter assembly. The apparatus includes a stalk segmenter assembly, a processor assembly, a plurality of cleaning conveyor modules and a cyclonic separator system to reclaim small bits of leaf from the waste stream and return them through a rotary airlock to the segmenter assembly for reprocessing.

20 Claims, 8 Drawing Sheets

(56) References Cited

U.S. PATENT DOCUMENTS

| | | | | | |
|---|---|---|---|---|---|
| 4,172,515 | A | * | 10/1979 | Wochnowski | B65D 90/48 131/108 |
| 4,246,911 | A | | 1/1981 | Boogers | |
| 4,251,356 | A | | 2/1981 | Harte | |
| 4,306,574 | A | * | 12/1981 | Schlie | A24B 7/14 131/109.3 |
| 4,323,084 | A | | 4/1982 | Jenkins, Jr. et al. | |
| 4,350,172 | A | * | 9/1982 | Guthrie | A24B 5/00 131/322 |
| 4,449,540 | A | | 5/1984 | Marshall et al. | |
| 4,465,194 | A | | 8/1984 | Coleman | |
| 4,509,536 | A | | 4/1985 | Bennett et al. | |
| 4,566,470 | A | | 1/1986 | Brackmann | |
| 4,566,471 | A | | 1/1986 | Kumasako et al. | |
| 4,618,415 | A | | 10/1986 | Vecchio et al. | |
| 4,701,256 | A | | 10/1987 | Cross, Jr. | |
| 4,773,434 | A | * | 9/1988 | Miyake | A01D 45/16 131/313 |
| 4,915,824 | A | | 4/1990 | Surtees | |
| 5,012,824 | A | | 5/1991 | Ray | |
| 5,205,415 | A | | 4/1993 | Surtees | |
| 5,427,248 | A | | 6/1995 | Levy et al. | |
| 5,538,017 | A | | 7/1996 | Webb et al. | |
| 6,394,098 | B1 | * | 5/2002 | Cunningham | A24B 5/10 131/311 |
| 8,281,931 | B2 | | 10/2012 | Drewes et al. | |

* cited by examiner

METHOD AND APPARATUS OF PROCESSING WHOLE TOBACCO PLANTS

TECHNICAL FIELD

This document relates generally to the processing of whole tobacco plants and, more particularly, to a method and apparatus for cutting and classifying segments of tobacco plants and separating leaf material from undesirable stalk and shatter material for each class of leaf characteristics.

BACKGROUND

The leaf on different portions of a tobacco plant have different characteristics including nicotine content, color, body, texture, maturity, alkaloid content, and smoke flavor. For example, the tip portion adjacent the top of the plant generally has the youngest leaves and highest nicotine content. Tobacco companies use different classes of leaves to make different consumer products. Thus, proper and efficient classification of leaves is an important step in the overall cured tobacco sales process. The present method and apparatus allow one to more quickly and efficiently classify and separate leaves from whole tobacco plants for sale than previously possible.

SUMMARY

In accordance with the purposes and benefits described herein, a method is provided for processing whole tobacco plants. That method may be broadly described as comprising the steps of cutting whole tobacco plants including stalk, stems and leaves into segments in a segmenter assembly and classifying those segments by leaf characteristics. In addition, the method includes separating leaf material from a waste material stream of undesirable stalk and shatter material for each class of leaf characteristics, reclaiming portions of leaf material trapped in the waste material and recycling those reclaimed portions of leaf material through the separating process. Still further, the method may include lifting portions of leaf material out of the waste material stream by means of an air curtain. In one possible embodiment, that air curtain is produced by means of a centrifugal fan which provides constant negative pressure to lift the portions of leaf material from the waste material and a cyclonic separator to recover the leaf material from the air stream.

In accordance with additional aspects, the method may include classifying segments into at least three classes of leaf characteristics. In addition, the method may include using pneumatic separation and mechanical agitation to separate the leaf material from the undesirable stalk and shatter material.

Still further, the method may include providing an individual leaf material processor for each class of segments. In addition, the method may include feeding a first class of segments into a first leaf material processor, feeding a second class of segments into a second leaf material processor and feeding a third class of segments into a third leaf material processor.

In one possible embodiment, the method includes completing the feeding steps simultaneously. In one possible embodiment, the method includes providing an individual cleaning conveyor for each class of segments. In one possible embodiment, the method includes feeding a first class of segments from a first leaf material processor into a first cleaning conveyor, feeding a second class of segments from a second material processor into a second cleaning conveyor and feeding a third class segments from a third material processor into a third cleaning conveyor.

In accordance with an additional aspect, an apparatus is provided for processing whole tobacco plants. That apparatus may be described as comprising a stalk segmenter assembly including (a) a shearing module for cutting the whole tobacco plants including stalks, stems and leaves into segments, (b) at least on live bottom diverter for enhancing flow of and separating the segments into the plurality of grades and (c) a plurality of grade hoppers for classifying those segments by leaf characteristics. Still further, the apparatus includes a base assembly which houses a plurality of processors; each; processor comprising an oscillating walker for initial separation and dispersion of leaf, stalk, and shatter material; a cleaning shoe, and an adjustable stepped diverter contained within a processor shell.

The apparatus also includes a fan filter assembly for generating an airstream through the cleaning shoe. The airstream lifts relatively lightweight leaf material over the diverter into the hood of the cleaning conveyor, while the relatively heavy stalk and shatter materials are prevented by the diverter from passing onto the cleaning conveyor.

In addition, the apparatus includes a plurality of cleaning conveyor modules including a belted chain equipped for conveying predominately leaf material, which may contain stalk shatter and debris, received from the processors. The apparatus also includes oscillating trough pans and divertible air streams thereunder to clean and to convey the shatter and debris onto a tailings conveyor for disposal. Further, the apparatus includes a cyclonic separator system to reclaim small bits of leaf from the waste stream and return them through a rotary airlock to the segmenter assembly for reprocessing.

In one possible embodiment, the apparatus includes a live bottom diverter assembly having a conveyor belt and drive assembly. An actuator may be provided for adjusting an angle of the conveyor belt and thereby creating variable throat openings relative to the plurality of grade hoppers.

In one possible embodiment of the apparatus, the plurality of grade hoppers includes a first grade hopper, a second grade hopper and a third grade hopper, and the live bottom diverter assembly includes a first live bottom diverter having a first conveyor forming a divider between the first grade hopper and the second grade hopper and a second live bottom diverter having a second conveyor forming a divider between the second grade hopper and third grade hopper. A first actuator is provided for adjusting an orientation angle of the first conveyor relative to the first grade hopper and the second grade hopper while a second actuator is provided for adjusting the orientation angle of the second conveyor relative to the second grade hopper and the third grade hopper.

In one possible embodiment, the cleaning shoe conveys the stalk and shatter material under the diverter to a debris discharge outlet by oscillation. In one possible employment, a discharge conveyor is provided for receiving stalk and shatter material from a debris discharge outlet. In one possible embodiment, the apparatus includes an oscillating walker above the cleaning shoe, the walker allowing heavier stalk and shatter material to fall onto the cleaning shoe.

In the following description, there are shown and described several preferred embodiments of the processing method and associated apparatus. As it should be realized, the method and apparatus are capable of modification in various, obvious aspects all without departing from the method and apparatus as set out and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of a novel whole tobacco plant processing apparatus and together with the description serve to explain certain principles thereof. In the drawing figures.

Reference will now be made in detail to the present preferred embodiment of the processing apparatus, an example of which is illustrated in the accompanying drawing figures.

DETAILED DESCRIPTION

Figure 1:
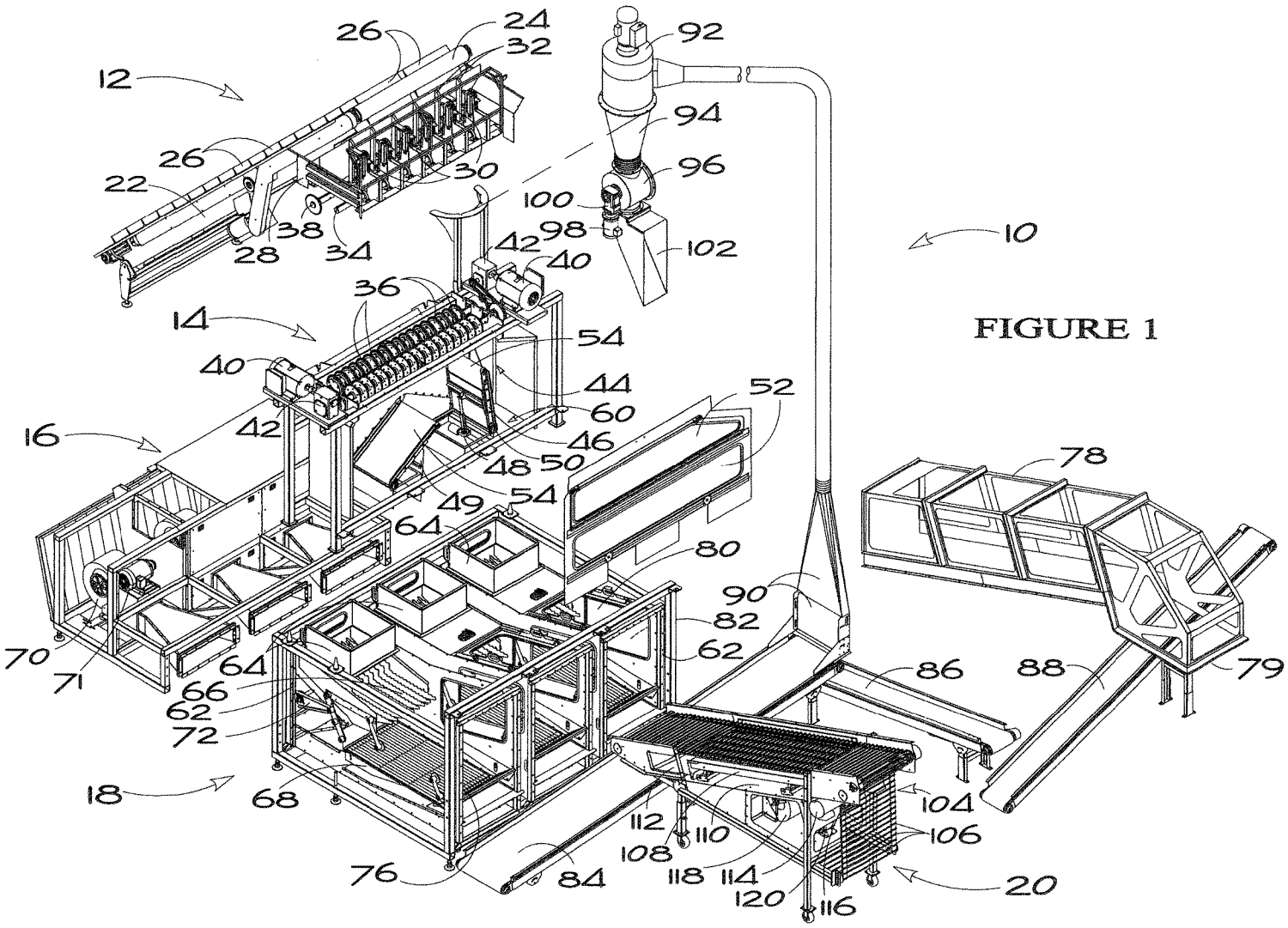
FIG. 1 is an exploded perspective view of an apparatus for processing whole tobacco plants.

Reference is now made to FIG. 1 which illustrates the apparatus 10 for processing of whole tobacco plants including stalks, stems and leaf. As illustrated, the apparatus 10 broadly includes a feed assembly 12, a segmenter assembly 14, a fan filter assembly 16, a separator assembly 18, and a multiple of cleaning conveyor modules 20.

Figure 2:
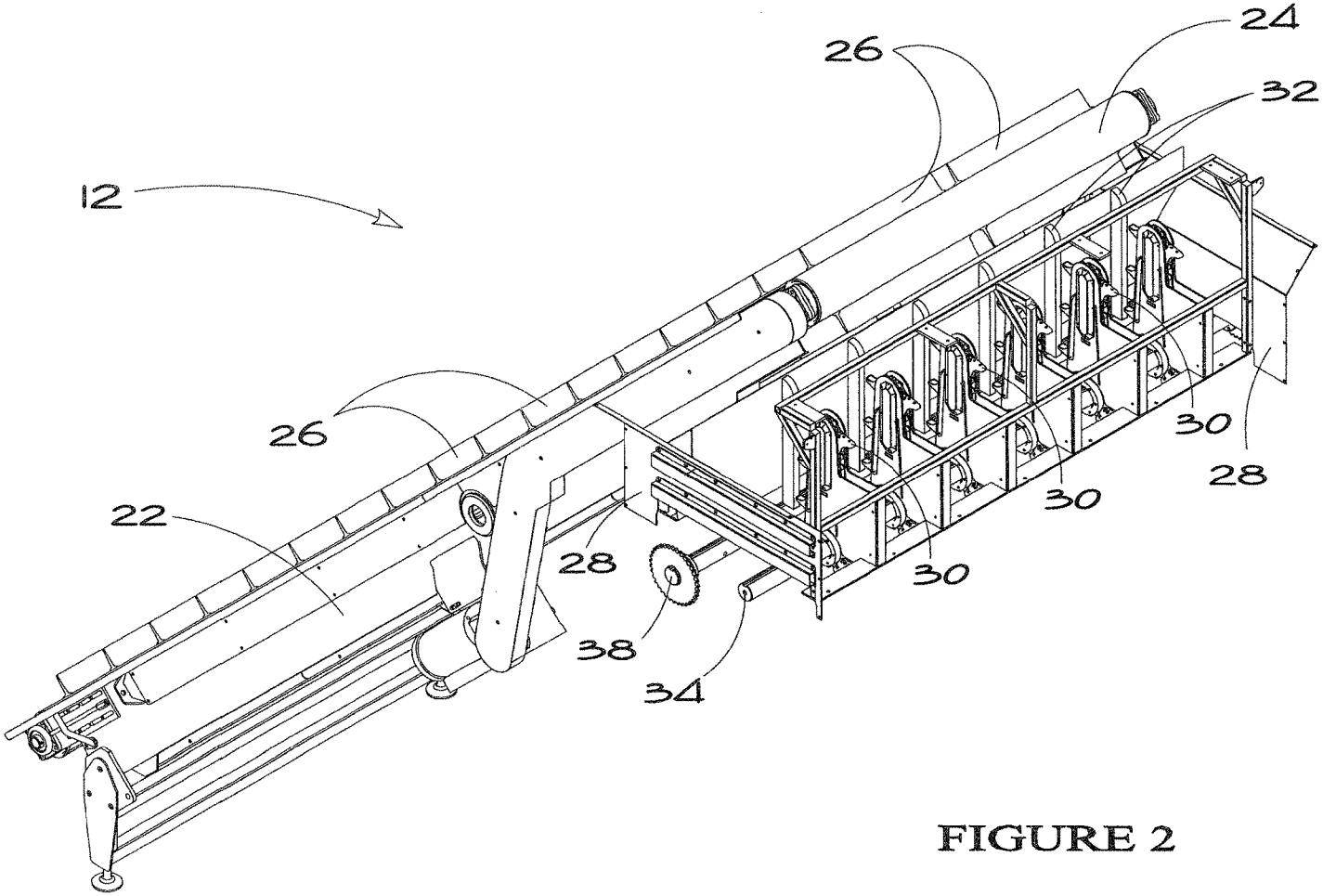
FIG. 2 is a detailed perspective view of the feed assembly of the apparatus illustrated in FIG. 1.

The feed assembly 12 includes an inclined conveyor 22 including a belt 24 having a series of spaced flights 26 (see FIG. 2). The flights 26 orient and register the tobacco plants so that they are fed laterally into the feeder house 28. The feeder house 28 includes a set of multiple, equally spaced gathering chains 30. The gathering chains 30 maintain the horizontal orientation of the whole tobacco plants against a set of guide ribs 32. The gathering chains 30 are driven by a common shaft 34 which alternately drives one set of the shearing discs 36 located immediately below the feeder house 28 in the segmenter assembly 14.

Figure 3:
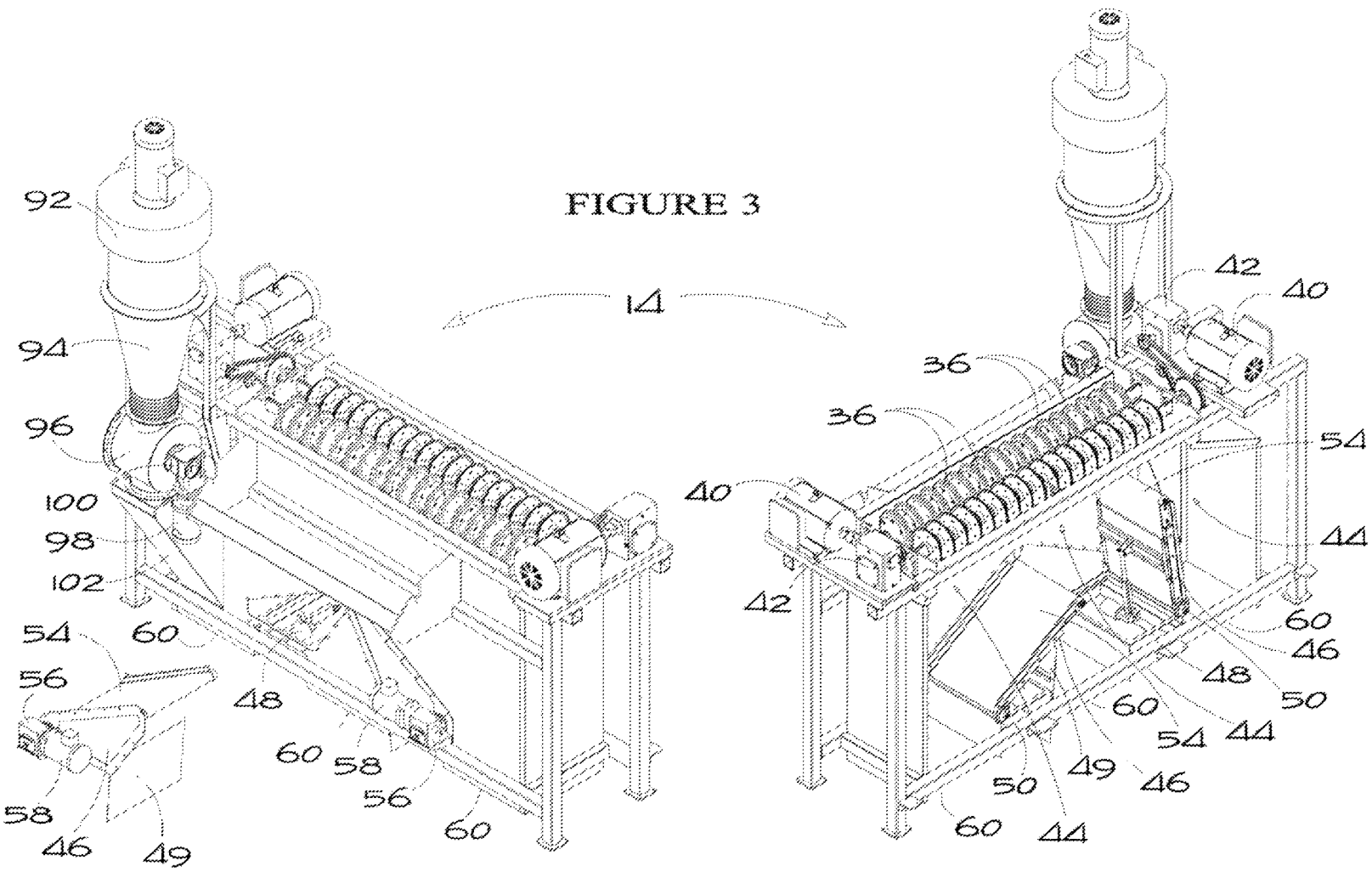
FIG. 3 is a detailed perspective view of the segmenter assembly of the apparatus illustrated in FIG. 1.

Reference is now made to FIG. 3 showing the segmenter assembly 14 in detail. The segmenter assembly 14 is comprised of two counter-rotating shafts 34, 38 each powered by an electric motor 40 and gear box 42 which drive the shearing discs 36. The horizontally aligned whole tobacco plants are positively conveyed downward through the shearing discs 36 so that the whole plants are cut into short, equal length segments of leaf material and stalk which may include leaf nodes. The shearing discs 36 can also produce small fragments of stalk material herein defined as shatter. The leaf and stalk segments (including shatter) exit the shearing discs 36 and fall vertically into a set of grade hoppers 44 which determine the grade of the leaf material.

In the illustrated embodiment, the segmenter assembly 14 is equipped with three grade hoppers 44 which are separated by and feature two hinged, adjustable live bottom diverter assemblies 46 that divide or separate the plant segments into three categories/classes or grades. The segments are grouped according to axial position or location along the stalk to determine the grades. One may adjust the relative positioning of the diverter assemblies 46 by extending or retracting the electromechanical linear actuators 48 thereby causing the diverter to rotate about its base shaft 50. Rotation of the diverter assemblies 46 changes the throat opening of the grade hoppers 44 providing real time grade adjustments by the operator. Material flow may be directly observed through the segmenter windows 52 (see FIG. 1).

Figure 4:
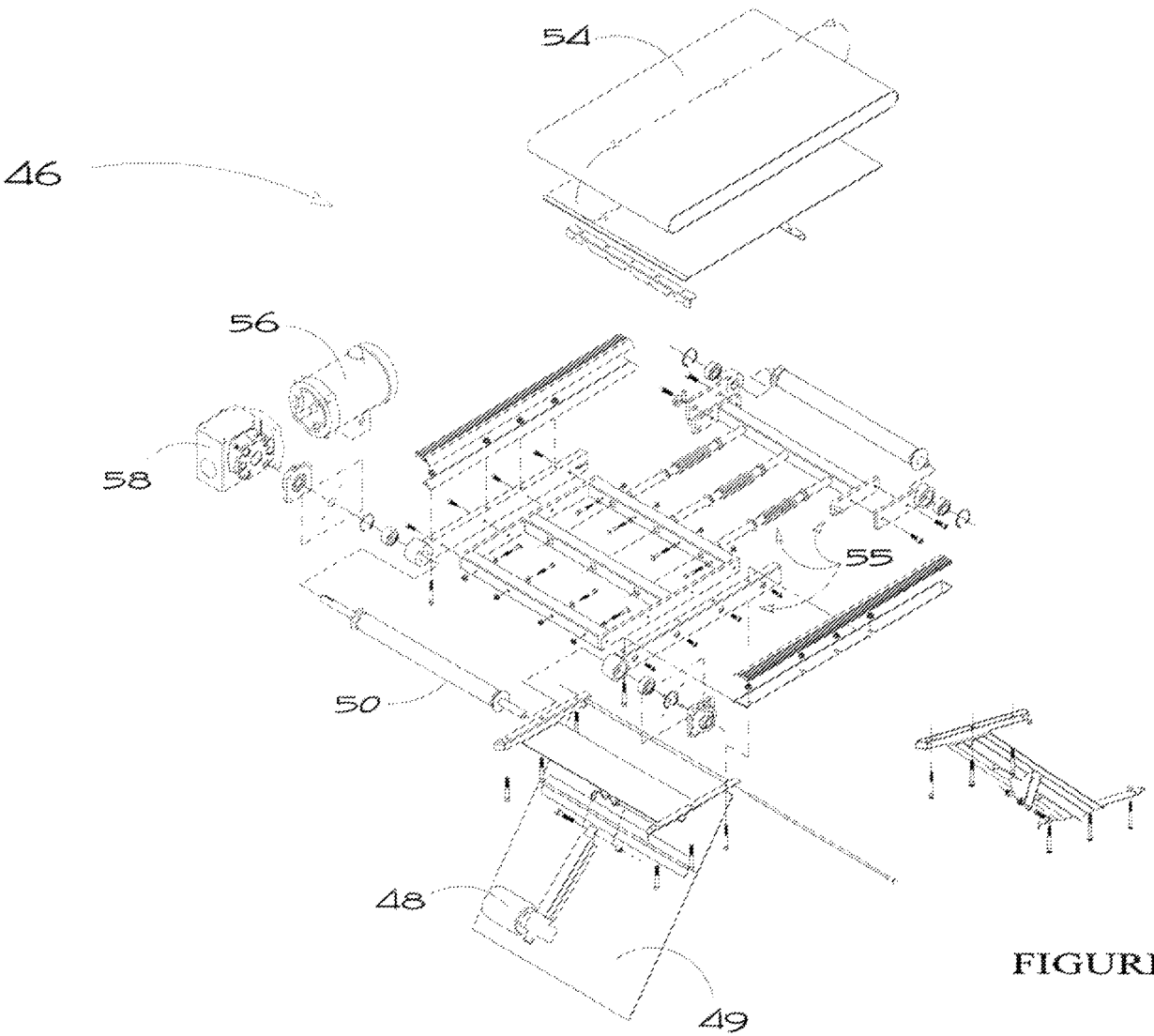
FIG. 4 is a detailed perspective view of the diverter assembly of the apparatus illustrated in FIG. 1.

Reference is now made to FIG. 4 showing one live bottom diverter assembly 46 in detail. The live bottom diverter assembly 46 is comprised of a conveyor belt 54 on an internally spring-biased frame 55 which is mounted to and rotates about a base shaft 50. The base shaft 50 is driven by a drive assembly including an electric motor 56 and a gearbox 58. The angle or inclination of the live bottom diverter assembly 46 is user adjustable by extension or retraction of an electromechanical linear actuator 48. The electromechanical linear actuator 48 is covered by a hinged, spring biased panel 49 which constitutes the inner walls of the middle grade hopper 44. The continual revolution of the conveyor belt 54 significantly reduces the possibility of leaf and/or stalk material bridging on the upward end of the live bottom diverter assembly 46. This feature greatly enhances material flow through the segmenter assembly 14 providing a significant improvement over previous embodiments which included only static diverter panels.

As best illustrated in FIGS. 1, 3, 6 and 8, the graded leaf material and stalk segments fall vertically from the three grade hoppers 44 into individual processors 62 through the discharge chutes 60 of the segmenter assembly 14. The material enters the top of the individual processors 62 through free floating transitions 64 mounted on rubber vibration strips. The free floating transitions 64 isolate the stationary segmenter assembly 14 from the oscillating individual processors 62 mounted in the separator assembly 18.

Figure 5:
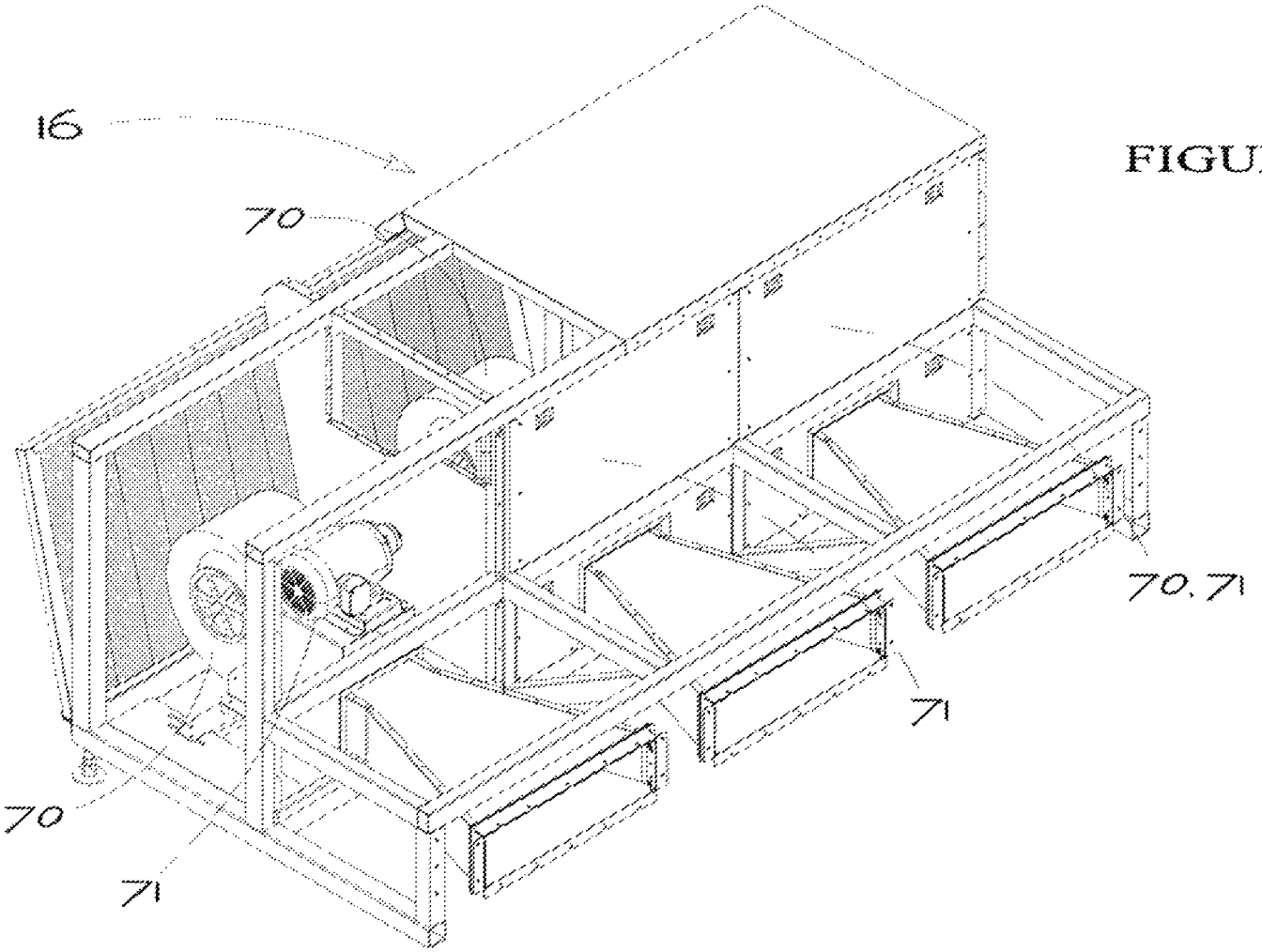
FIG. 5 is a detailed perspective view of the fan filter assembly of the apparatus illustrated in FIG. 1.
Figure 6:
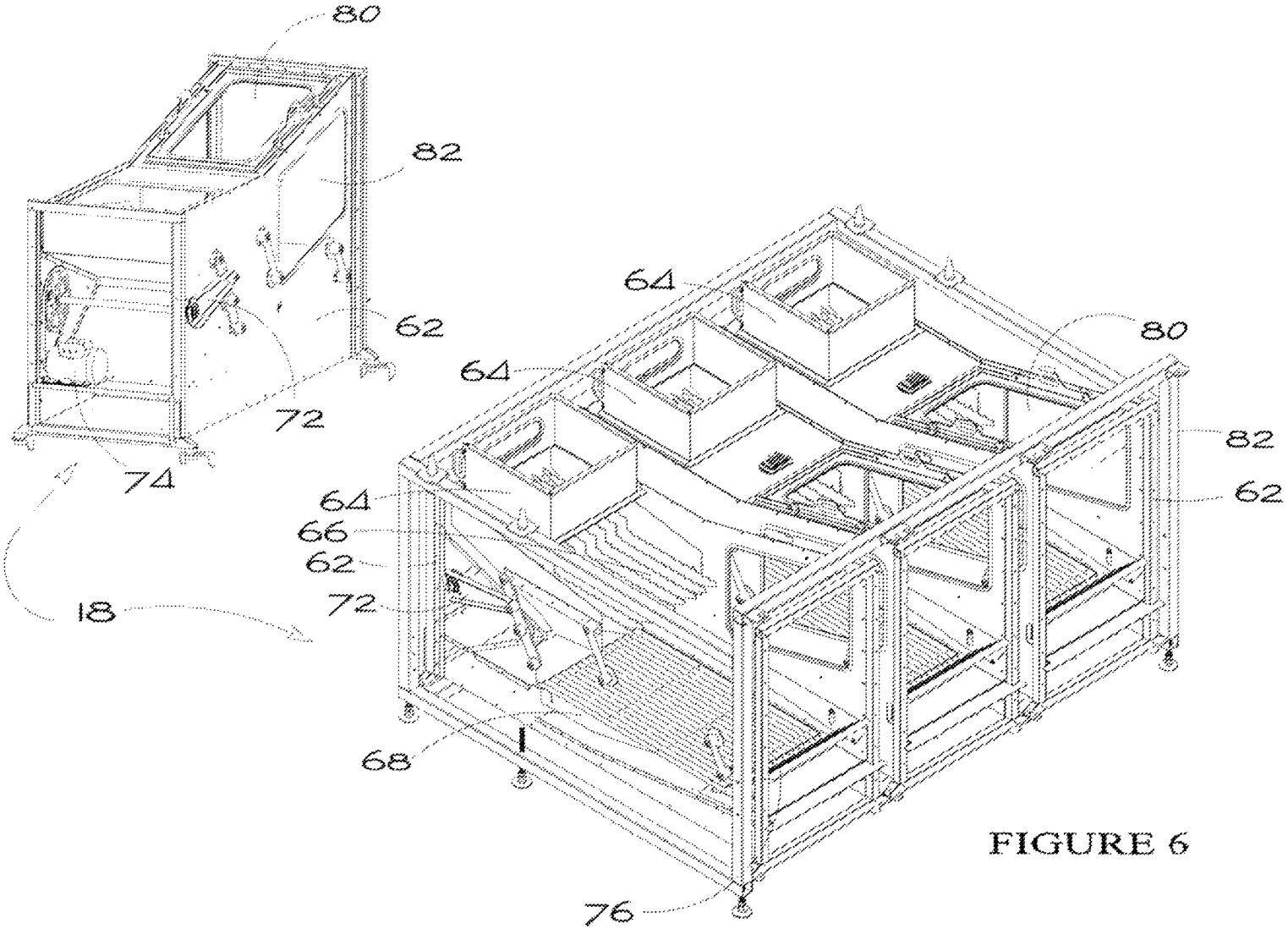
FIG. 6 is a detailed perspective view of the separator assembly of the apparatus illustrated in FIG. 1.
Figure 8:
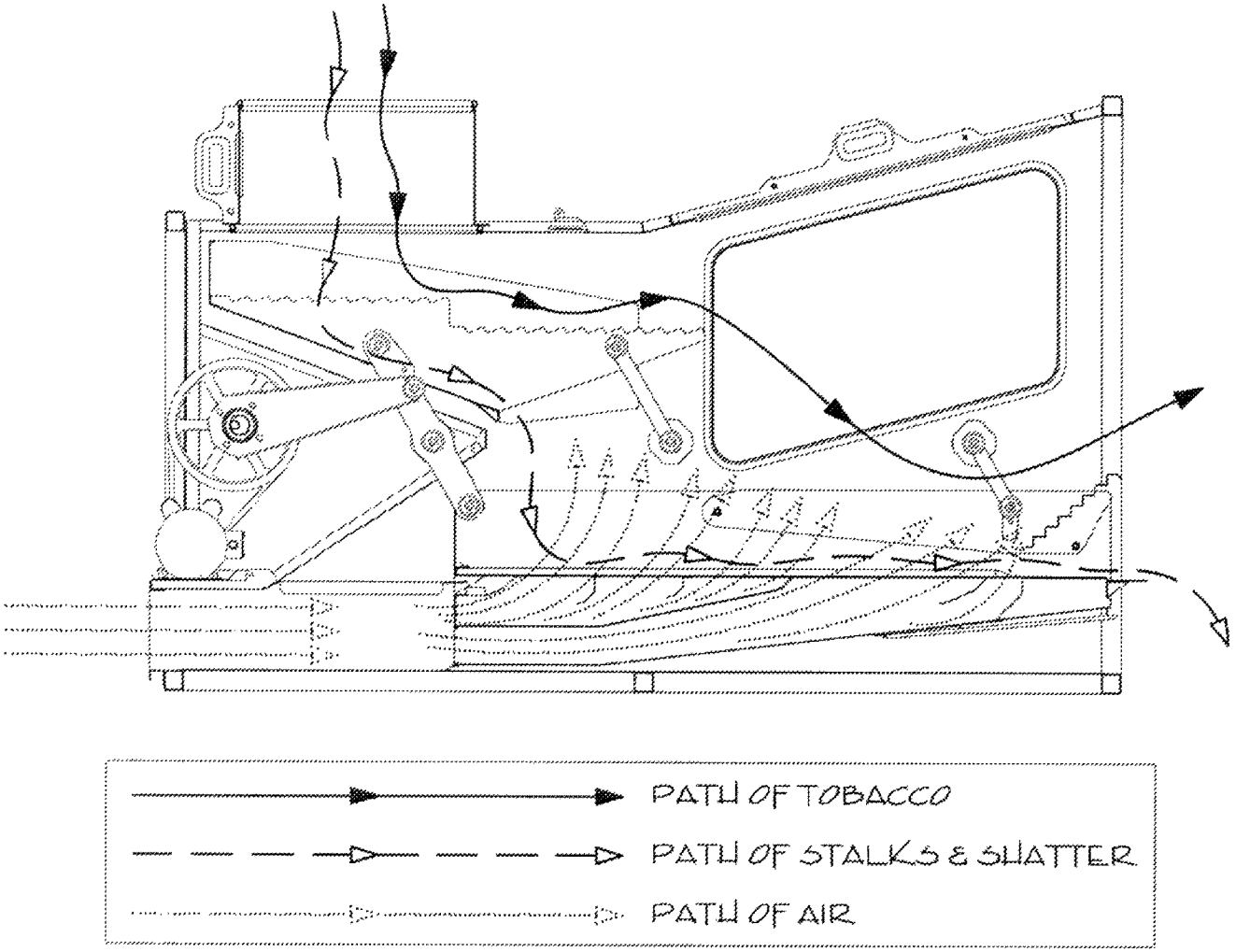
FIG. 8 is a detailed material flow schematic for the separator assembly of the apparatus illustrated in FIG. 1.

The processors 62 use a combination of variable mechanical agitation and variable air flow rate to pneumatically separate the lighter leaf material from the heavier stalk segments and undesirable stalk debris referred to as shatter which may be introduced into the material stream as a result of the cutting action of the shearing discs 36 As best illustrated in FIGS. 1, 6 and 8, each processor 62 includes an oscillating walker 66 positioned to receive the segmented stalk and leaf material falling from the cooperating grade hopper 44. The oscillating walker 66 provides for primary separation of the leaf material from the stalk material and shatter. More specifically, the relatively light leaf material forms a mat upon and passes along the oscillating walker 66 while the relatively heavy stalk material falls through the oscillating walker onto the underlying cleaning shoe 68. Further, a majority of the shatter falls through the oscillating walker 66 owing to its non-aerodynamic shape and size. This material is, however, light weight and may be trapped within the leaf material as it moves across the oscillating walker 66. Here it should be appreciated that each processor 62 is connected by a rigid metal duct to a variable speed fan assembly 70 contained wholly within the fan filter assembly 16 and which generates an air stream that travels upwardly through the cleaning shoe 68 (see FIG. 5). That air stream helps support the light weight leaf material on the oscillating walker 66 so that it may be tumbled for initial cleaning of shatter and debris and delivered to the leaf cleaning conveyor module 20 (see FIG. 8).

The variable mechanical agitation is provided by adjusting the mechanical linkage 72 to the walkers 66 in order to change the amplitude of the oscillation and/or the rotational speed of the crank arm drive motor 74 to change the frequency of the oscillation. The air flow rate of the fan 70 is varied by adjusting the speed of the drive motor 71, and the direction and flow is varied by changing the orientation of the variable vanes (see FIG. 8) under the surface of the cleaning shoe 68.

Figure 7:
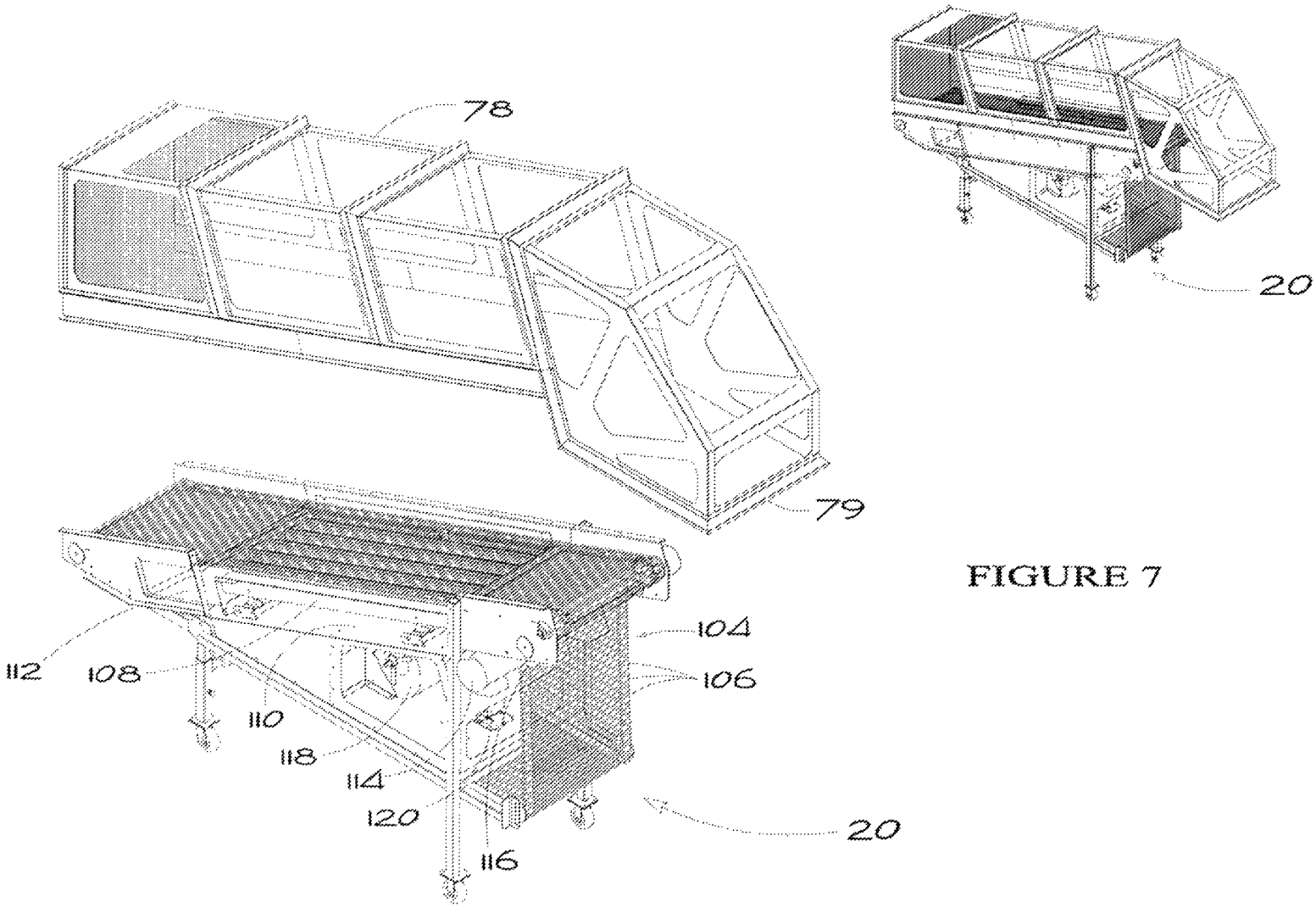
FIG. 7 is a detailed perspective view of a cleaning conveyor module of the apparatus illustrated in FIG. 1.

Any leaf material which may pass through the oscillating walker 66 is picked up and entrained with the air stream and carried over the stepped diverter 76 and into the hood 78 of the cleaning conveyor module 20 (see FIGS. 1, 7 and 8). As should be appreciated, the stepped diverter 76 is adjustable in height to allow fine adjustment of the separation process and ensure the maximum recovery of leaf material and best separation of that leaf material from undesirable stalk and shatter material. Further, it should be appreciated that the separation process is visible to the operator through the window panels 80, 82 from the point the material enters the processor 62 until it exits over the stepped diverter 76 into the cleaning conveyor module 20 or under the stepped diverter into the tailings conveyor 84. This increased visibility greatly enhances the operator's ability to make real time speed adjustments to the oscillating walker 66 and the variable speed fan 70 thereby greatly improving material cleaning over previous embodiments.

The undesirable stalk and shatter material is conveyed by the oscillation of the cleaning shoe 68 underneath the stepped diverter 76 to a discharge outlet. The undesirable stalk and shatter material passing through the discharge outlet falls onto the tailings conveyor 84 which conveys that material to the cross conveyor 86 and thence into the elevating conveyor 88 for conveying the debris material to a wagon or spreader for return and reincorporation into the field.

It should be appreciated that some small portions of leaf material may be trapped under the stalk segments falling through the oscillating walker 66 and thus be conveyed across the cleaning shoe 68 to the discharge outlet and onto the tailings conveyor 84. These small segments are relatively light compared to the heavier stalk material and are aerodynamically buoyant. Accordingly, the waste stream is passed through an adjustable air curtain 90 located at the exit point of the tailings conveyor 84 and powered by a cyclonic separator 92 which provides constant negative pressure or vacuum to lift small leaf segments out of the waste stream (see FIG. 1). These reclaimed leaf portions are collected in a tapered hopper 94 which feeds via gravity into a rotating, four chamber air lock 96 powered by an electric motor 98 and a right angle gearbox 100. The four chambers of the air lock 96 are configured to maintain negative pressure relative to the upstream side at the adjustable air curtain 90 while allowing the reclaimed portions of leaf to be reintroduced to the segmenter assembly 14 through the tailings hopper 102 located directly beneath the rotary air lock 96.

Reference is now made to FIG. 7 showing the cleaning conveyor module 20 in detail. The cleaning conveyor module 20 receives material in an airstream which carries separated leaf segments and a small amount of shatter over the stepped diverter 76. The cleaning conveyor module 20 includes a hood 78 designed to relieve air pressure from the airstream and allow the material stream to settle onto a belted chain 104 comprised of parallel round slats 106 fastened to narrow strips of conveyor belting at each end. The belted chain 104 receives the settled leaf material which bridges over the parallel slats 106 alternately allowing the smaller shatter to fall through into the oscillating trough pans 108 which convey the debris down the conveyor body 110 to an exit chute 112. The oscillating trough pans 108 are connected to the conveyor body 110 through the rocker links and driven by an electric motor 114 and a gearbox 116 powering an eccentric linkage (not shown). The speed of the oscillation may be adjusted by varying the speed of the electric motor 114.

The cleaning conveyor module 20 further includes a fan 118 driven by an electric motor 120 to provide pneumatic tumbling of the leaf material to dislodge any remaining shatter. The sides of the oscillating trough pans 108 are formed so as to allow air jets to blow upward through the belted chain 104 and tumble the leaf material as it is conveyed upward toward the discharge outlet 79 thus removing any remaining debris. As best illustrated in FIGS. 1 and 7, the debris and shatter is conveyed down the oscillating trough pans 108 and collected in a sloped exit chute 112 which is positioned directly over the tailings conveyor 84. It should be appreciated that this waste stream effectively merges with the waste stream from the individual processors 62 and that any small portions of leaf which may have passed through the belted chain 104 will subsequently pass through the air curtain 90 and be reclaimed and reintroduced to the segmenter assembly 14.

Each of the cleaning conveyor modules 20 ultimately feeds the cleaned leaf material through the discharge outlet 79 to a leaf material packaging system (not shown). Here it should again be noted that one processor 62 is provided for simultaneously separating leaf material from each grade hopper 44. Further, each processor 62 communicates to an individual cleaning conveyor module 20. Only one cleaning conveyor module 20 is illustrated in FIGS. 1 and 7. The two cleaning conveyor modules 20 nearest the viewer have been removed from the illustration for purposes of clarity.

As should be appreciated, the apparatus 10 may be used in a method of processing of whole tobacco plants. That method may be broadly described as comprising the steps of cutting whole tobacco plants including stalks, stems and leaves into segments in a segmenter assembly 14, classifying those segments by leaf quality, separating leaf material from a waste stream of undesirable stalk and shatter material for each class of leaf characteristics and reclaiming portions of leaf material trapped in the waste material and recycling the reclaimed portions of leaf material to the segmenter assembly. As should be appreciated, the apparatus 10 is capable of completing the separation of leaf material for each class of leaf characteristics simultaneously thereby maximizing processing efficiency. Further, the apparatus 10 is capable of repeating the process at a high rate of throughput providing a more consistent product at a higher processing capacity, thereby improving quality.

The method may further be described as including the step of lifting portions of the leaf material out of the waste stream by means of an air curtain 90. More specifically, the method may include producing the air curtain by means of a cyclonic separator 92 which provides a relatively constant negative pressure to lift the portions of leaf material from the waste stream.

As also should be apparent from the above description of the apparatus 10, the method includes classifying into at least three classes of leaf characteristics. Further the method includes using pneumatic separation combined with variable rate mechanical agitation to separate the leaf material from the undesirable stem and shatter material.

Still further, the method of processing whole tobacco plants may include providing an individual processor 62 for each class of segments. Thus, the method may include feeding the first class of segments into a first material leaf material processor 62, feeding a second class of segments into a second leaf material processor 62 and feeding a third class of segments into a third leaf material processor 62. This may be done simultaneously.

The method may be further described as including the step of eliminating the bulk and weight of the undesirable stalk and shatter material from the leaf material being shipped to the downstream consumer tobacco product processing facility. Toward this end, the method may include providing individual leaf cleaning conveyors 20 for each class of segments. Thus, a first class of segments may be fed into a first cleaning conveyor 20 while a second class of segments is fed into a second cleaning conveyor 20 and a third class of segments is fed into a third cleaning conveyor 20. These feeding steps may also be done simultaneously.

In one particularly useful embodiment, a whole tobacco plant curing facility is provided comprising a curing structure, such as a barn, a building, a temporary or semi-permanent structure, field curing racks or frames where tobacco is hung and air cured and a whole tobacco plant processing apparatus 10 as described above.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. A method of processing whole tobacco plants, comprising:

cutting whole tobacco plants including stalks, stems and leaves into segments in a segmenter assembly;

classifying said segments by leaf characteristics;

simultaneously separating leaf material from a waste material stream of undesirable stalk and shatter material for each class of leaf characteristics; and reclaiming portions of leaf material trapped in said waste material and recycling said reclaimed portions of leaf material to said segmenter assembly.

2. The method of claim 1, further including lifting portions of leaf material out of said waste material stream by means of an air curtain.

3. The method of claim 2, including producing said air curtain by means of a cyclonic separator which provides constant negative pressure to lift said portions of leaf material from said waste material stream.

4. The method of claim 1, including classifying said segments into at least three classes of leaf characteristics.

5. The method of claim 4, including using pneumatic separation and mechanical agitation to separate said leaf material from said undesirable stalk and shatter material.

6. The method of claim 1, including providing an individual leaf material processor for each class of segments.

7. The method of claim 6, including feeding a first class of segments into a first leaf material processor, feeding a second class of segments into a second leaf material processor, and feeding a third class of segments into a third leaf material processor.

8. The method of claim 7, including completing said feeding steps simultaneously.

9. The method of claim 1, including providing an individual cleaning conveyor for each class of segments.

10. The method of claim 9, including feeding a first class of segments from a first leaf material separator into a first cleaning conveyor, feeding a second class of segments from a second material separator into a second cleaning conveyor, and feeding a third class of segments from a third material separator into a third cleaning conveyor.

11. The method of claim 10, including completing said feeding steps simultaneously.

12. An apparatus for processing whole tobacco plants comprising:

a stalk segmenter assembly including (a) a shearing module for cutting the whole tobacco plants including stalks, stems and leaves into segments and (b) a plurality of grade hoppers for classifying said segments by leaf quality; and a processor assembly including a plurality of processors including an oscillating walker, a cleaning shoe, and an adjustable diverter;

a plurality of cleaning conveyor modules including a hood and a belted chain to receive and clean leaf material received from said processors and including oscillating trough pans and variable air streams to clean and to convey said shatter and debris onto a tailings conveyor for disposal;

a fan filter assembly generating an airstream through said cleaning shoe, said airstream lifting relatively light weight leaf material over said diverter into said hood of said cleaning conveyors while said relatively heavy stalk and shatter material is prevented by said diverter from passing onto said cleaning conveyor; and a cyclonic separator system to reclaim small bits of leaf from the waste stream and return them through a rotary air lock to the segmenter assembly for reprocessing.

13. The apparatus of claim 12, wherein said stalk segmenter assembly includes a live bottom diverter having a conveyor belt and drive assembly.

14. The apparatus of claim 13, further including an actuator for adjusting an angle of said conveyor belt relative to said plurality of grade hoppers.

15. The apparatus of claim 12, wherein said plurality of grade hoppers includes a first grade hopper, a second grade hopper and a third grade hopper, and said segmenter assembly includes a first live bottom diverter assembly having a first conveyor forming a divider between said first grade hopper and said second grade hopper and a second live bottom diverter assembly having a second conveyor forming a divider between said second grade hopper and said third grade hopper.

16. The apparatus of claim 15, further including a first actuator for adjusting an orientation angle of said first conveyor relative to said first grade hopper and second grade hopper.

17. The apparatus of claim 16, further including a second actuator for adjusting an orientation angle of said second conveyor relative to said second grade hopper and said third grade hopper.

18. The apparatus of claim 17 wherein said cleaning shoe conveys said stalk and shatter material under said diverter to a debris discharge outlet by oscillation.

19. The apparatus of claim 18, further including a discharge conveyor which receives stalk and shatter material from said debris discharge outlet.

20. The apparatus of claim 18, further including an oscillating walker above said cleaning shoe, said oscillating walker allowing heavier stalk and shatter material to fall onto said underlying cleaning shoe.

* * * * *